US005284073A

United States Patent [19]

Wright et al.

[11] Patent Number: 5,284,073

[45] Date of Patent: Feb. 8, 1994

[54] SOCKET WRENCH OPENING

[75] Inventors: Richard B. Wright, Akron; Theodore M. Vozenilek, Canton, both of Ohio

[73] Assignee: Wright Tool Company, Barberton, Ohio

[21] Appl. No.: 914,055

[22] Filed: Jul. 13, 1992

Related U.S. Application Data

[63] Continuation of Ser. No. 671,195, Mar. 18, 1991.

[51] Int. Cl.[5] ..... B25B 13/06

[52] U.S. Cl. ..... 81/121.1; 81/186; 81/124.4

[58] Field of Search ..... 81/121.1, 124.4, 186

[56] References Cited

U.S. PATENT DOCUMENTS

| | | | |
|---|---|---|---|
| 2,777,353 | 1/1957 | Willis | 85/45 |
| 3,079,819 | 3/1963 | Wing | 81/121 |
| 3,125,910 | 3/1964 | Kavalar | 81/121 |
| 3,242,775 | 3/1966 | Hinkle | 81/119 |
| 3,273,430 | 9/1966 | Knudsen et al. | 81/121 |
| 3,354,757 | 11/1967 | Grimm et al. | 81/90 |
| 3,466,956 | 9/1969 | Bowers | 81/121 |
| 3,495,485 | 2/1970 | Knudsen et al. | 81/121 |
| 3,675,516 | 7/1972 | Knudsen et al. | 81/121 |
| 3,885,480 | 5/1975 | Muenchinger | 81/121 R |
| 3,903,764 | 9/1975 | Andersen | 81/121 R |
| 3,908,488 | 9/1975 | Andersen | 81/121 R |
| 4,010,670 | 3/1977 | Lejdegard | 85/45 |
| 4,100,824 | 7/1978 | Marschke | 81/121 R |
| 4,361,412 | 11/1982 | Stolarczyk | 411/402 |
| 4,512,220 | 4/1985 | Barnhill, III et al. | 81/121.1 |
| 4,581,957 | 4/1986 | Dossier | 81/121.1 |
| 4,598,616 | 7/1986 | Colvin | 81/124.6 |
| 4,882,957 | 11/1989 | Wright et al. | 81/121.1 |
| 5,012,706 | 5/1991 | Wright et al. | 81/121.1 |

FOREIGN PATENT DOCUMENTS 602687 3/1960 Italy .

*Primary Examiner*—James G. Smith

*Attorney, Agent, or Firm*—D. Peter Hochberg; Mark Kusner; Michael Jaffe

[57] ABSTRACT

A wrench for turning a fastener nut having a central axis and an even-numbered plurality of flat bounding surfaces parallel to the fastener access wherein diametrically opposite pairs of surfaces are parallel to each other and the bounding surfaces intersect in adjacent pairs to form fastener corners. The wrench includes a fastener nut socket defined by a central socket axis. The socket includes a plurality of uniformly spaced peripherally and radially disposed sides and a plurality of uniformly spaced fastener corner clearance recesses disposed between sides. Each side includes a planar surface and a pair of complimentary surfaces, wherein a complimentary surface diverges outwardly from each end of the planar surface at an angle of approximately three degrees (3°). The planar surface has a length approximately equal to 0.35 times (×) the minor diameter of the fastener nut to be driven. Each corner recess is comprised of a radiused surface, the complimentary surfaces being dimensioned to intersect the radiused surface.

1 Claim, 3 Drawing Sheets

SOCKET WRENCH OPENING

This is a continuation of co-pending application Ser. No. 07/671,195 filed on Mar. 18, 1991.

FIELD OF THE INVENTION

The present invention relates generally to a rotary tool for driving a hexagonal threaded fastener, and more particularly to a wrench socket opening having driving surfaces which improve the internal stress distributions of the socket.

BACKGROUND OF THE INVENTION

The present invention relates to improvements in wrench socket designs which redistribute and reduce the internal stresses exerted on the socket during driving and which improve the driving performance of the socket by providing a driving surface at an angle which best matches the fastener face to be driven.

When designing socket wrench openings, to avoid breakage of the wrench and/or deformation of the fastener, it is desirable to minimize the stress exerted on the socket. It is likewise desirable to distribute, as uniformly as possible, the stress exerted on the socket. Stress analysis indicates that three important points of high stress exist when a socket wrench engages the flank or face of a hexagonal or double hexagonal fastener. The first area of stress is where the wrench driving surface meets the fastener face. It is desirable that this surface be as large as possible to more uniformly distribute the stress throughout the socket. It is also important that the drive surface be, as nearly as possible, parallel to the fastener face to minimize peak stress. This is achieved by orienting the drive surface at an angle which takes into account the position of the wrench when it engages the fastener. In this respect, a small clearance exists between the internal socket surface and the fastener to be driven. As this clearance is taken up in turning the wrench to engage the fastener, the wrench is angularly displaced relative to the fastener. Thus, there is a need to choose an angle for the wrench driving surfaces of the socket which best matches that of the fastener when the wrench is in the angularly displaced position.

The second important area of stress concentration is at the outer edge where the driving surface of the socket wrench ceases to contact the fastener, i.e. at the corner of the fastener. Because there is an abrupt contact pressure area at the corner of the fastener which results in an abrupt stress peak, it is desirable that the driving surface not contact the fastener at the corner thereof.

The third area of stress concentration is the portion of the wrench socket adapted to receive the corner of the fastener. In conventional wrench design, this area is a sharp arcuate angle which acts to concentrate the stress exerted on the socket.

The present invention provides a socket wrench opening which maximizes the drive face, avoids contact with the corner of the fastener, and eliminates a sharp angle, i.e. corner, and further provides a wrench socket opening shape which lends itself to efficient, reproducible, and economical manufacture.

SUMMARY OF THE INVENTION

In accordance with the present invention there is provided a wrench for turning a fastener nut having a central axis and an even numbered plurality of flat bounding surfaces parallel to the fastener access wherein diametrically opposite pairs of surfaces are parallel to each other and the bounding surfaces intersect in adjacent pairs to form fastener corners. The wrench includes a fastener nut socket defined by a central socket axis. The socket includes a plurality of uniformly spaced peripherally and radially disposed sides and a plurality of uniformly spaced fastener corner clearance recesses disposed between sides. Each side includes a planar surface and a pair of complimentary surfaces, wherein a complimentary surface diverges outwardly from each end of the planar surface. The planar surface has a length substantially equal to 0.35 times (×) the minor diameter of the fastener nut to be driven. The "minimum dimension" of the fastener nut, means the "minimum across the flats of a minimum gauge.") In the tool industry, the standard minimum size of a wrench opening is determined by a GO-gauge, which is the largest gauge which will fit into a socket opening to meet the customary standards acceptable for a specific size fastener. Each corner recess is comprised of a radiused surface having a radius of curvature of approximately 0.075 times (×) the minor diameter of the fastener to be driven, the complimentary surfaces being dimensioned to intersect the radiused surface.

In accordance with another aspect of the present invention, there is provided a wrench for turning a fastener nut having a central axis and an even numbered plurality of flat bounding surfaces parallel to the fastener access wherein diametrically opposite pairs of surfaces are parallel to each other and the bounding surfaces intersect in adjacent pairs to form fastener corners. The wrench includes a fastener nut socket defined by a central socket axis. The socket includes a plurality of uniformly spaced peripherally and radially disposed sides and a plurality of uniformly spaced fastener corner clearance recesses disposed between sides. Each side, which acting on a fastener is referred to herein as the "driving surface," includes a planar surface and a pair of complimentary surfaces, wherein a complimentary surface diverges outwardly from each end of the planar surface. The planar surface has a length approximately 0.35 times (×) the minimum diameter of the fastener nut to be driven. The complimentary surface diverges from the planar surface at an angle of approximately three degrees (3°), and intersects ("intersects" means intersecting the recess, rather than being tangent to or not joining the recess) a corner recess which is comprised of a radiused surface.

In accordance with another aspect of the present invention, there is provided a wrench for turning a fastener nut having a central axis and an even numbered plurality of flat bounding surfaces parallel to the fastener access wherein diametrically opposite pairs of surfaces are parallel to each other and the bounding surfaces intersect in adjacent pairs to form fastener corners. The wrench includes a fastener nut socket defined by a central socket axis. The socket includes a plurality of uniformly spaced peripherally and radially disposed sides and a plurality of uniformly spaced fastener corner clearance recesses disposed between sides. Each side includes a planar surface and a pair of complimentary surfaces, wherein a complimentary surface diverges outwardly from each end of the planar surface at an angle of approximately three degrees (3°). The planar surface has a length greater than 0.35 times (×) the minimum dimension of the fastener nut to be driven. Each corner recess is comprised of a radiused surface having a radius of curvature of approximately 0.075 times (×) the minimum dimension of the fastener to be driven, the complimentary surfaces being dimensioned to intersect the radiused surface.

More specifically, the side surfaces of the socket opening are dimensioned to provide larger driving surfaces and are oriented to position these surfaces as close as possible to the flat surfaces of the fasteners during driving engagement. This provides a more uniform distribution of the stress exerted on the socket. The complimentary surfaces, which diverge from the planar surfaces, are positioned such that the planar surfaces of the socket avoid contact with the corner of the fastener. This eliminates any large stress peaks in the engaging surfaces. With respect to the corner recesses of the socket, the radiused corners and the complimentary surfaces are dimensioned to avoid large stress concentration found in sockets having corner clearance recesses defined by sharp arcuate angles or in sockets having large recesses which reduce the wall thickness of the socket.

Importantly, the claimed socket opening permits longer forging punch life. In this respect, in the practical business of making socket wrench openings, industry standards set certain tolerances which must be met and which effect the manufacture of the sockets. Generally socket openings are tested with gauges which establish the maximum and minimum opening sizes. In the art, it is generally well known that the corners of the forging punches generally wear faster than the flat engaging surfaces of the punch. It has been known to use as large a punch as possible so as to give a reasonable amount of wear on the corners before they become undersized. This results in the across flats dimension being on the large size if the punch is a hexagon design because the across the flats dimension is fixedly linked to the across the corners dimension of the punch. The present invention enables a punch having a reduced across the flat dimension wherein the initial size of the punch can be dimensioned to lie in the midsize of the gauging range. As set forth above, the included angle of the driving surfaces of the wrench are oriented to compensate for the rotation that occurs between the wrench and fastener in the process of engagement. The angle is chosen so as to produce close to parallel engagement between the engaging surface of the socket and the flat portion of the fastener over the range of acceptable fastener sizes. Thus, in addition to providing a socket opening which reduces and distributes more evenly the internal stress exerted on the socket during driving, the present design facilitates reproduction of the socket, as well as forging punch life.

It is an object of the present invention to provide a multi-sided drive for hexagonal fasteners having drive surfaces which are substantially parallel to the surface flats of the fasteners during driving.

It is another object of the present invention to provide a multi-sided drive as described above which eliminates sharp arcuate angles in the fastener corner clearance recess.

It is another object of the present invention to provide a multi-sided drive as described above which reduces and more uniformly distributes the internal stress that is exerted on the socket during driving.

Another object of the present invention is to provide a multi-sided drive as described above having a shape which lends itself to efficient reproduction and which facilitates longer forging punch life.

These and other objects and advantages will become apparent from the following description of a preferred embodiment of the invention taken together with the accompanying drawings.

DRAWINGS

The invention may take physical form in certain parts and arrangement of parts, an embodiment of which is described in detail in the specification and illustrated in the accompanying drawings wherein.

DETAILED DESCRIPTION OF THE PREFERRED EMBODIMENT

Figure 1:
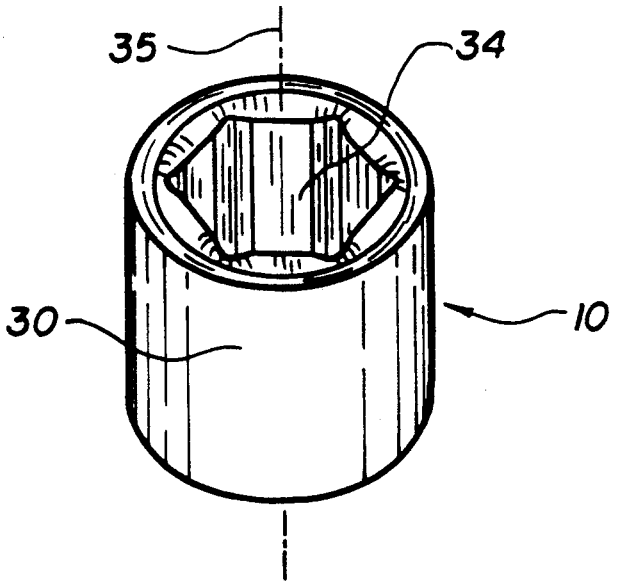
FIG. 1 is a perspective view of a socket wrench illustrating the shape of a preferred embodiment of the present invention.

Referring now to the drawings wherein the showings are for the purpose of illustrating a preferred embodiment of the present invention and not for purpose of limiting same, FIG. 1 shows a wrench socket 10 for turning a polygonally shaped element such as a conventionally known hexagonal threaded fastener. For the purpose of illustration, a hexagonal fastener 20 is shown in phantom in FIG. 2. Fastener 20 includes a number of planar faces 22 which are generally parallel and equidistant from a central axis 24. Faces or flanks 22 intersect at dihedral angles to form corners 26. The illustrated fastener 20 is considered as having standard dimensions for any given size and is within the maximum-minimum standard across opposed faces 22—22.

Figure 2:
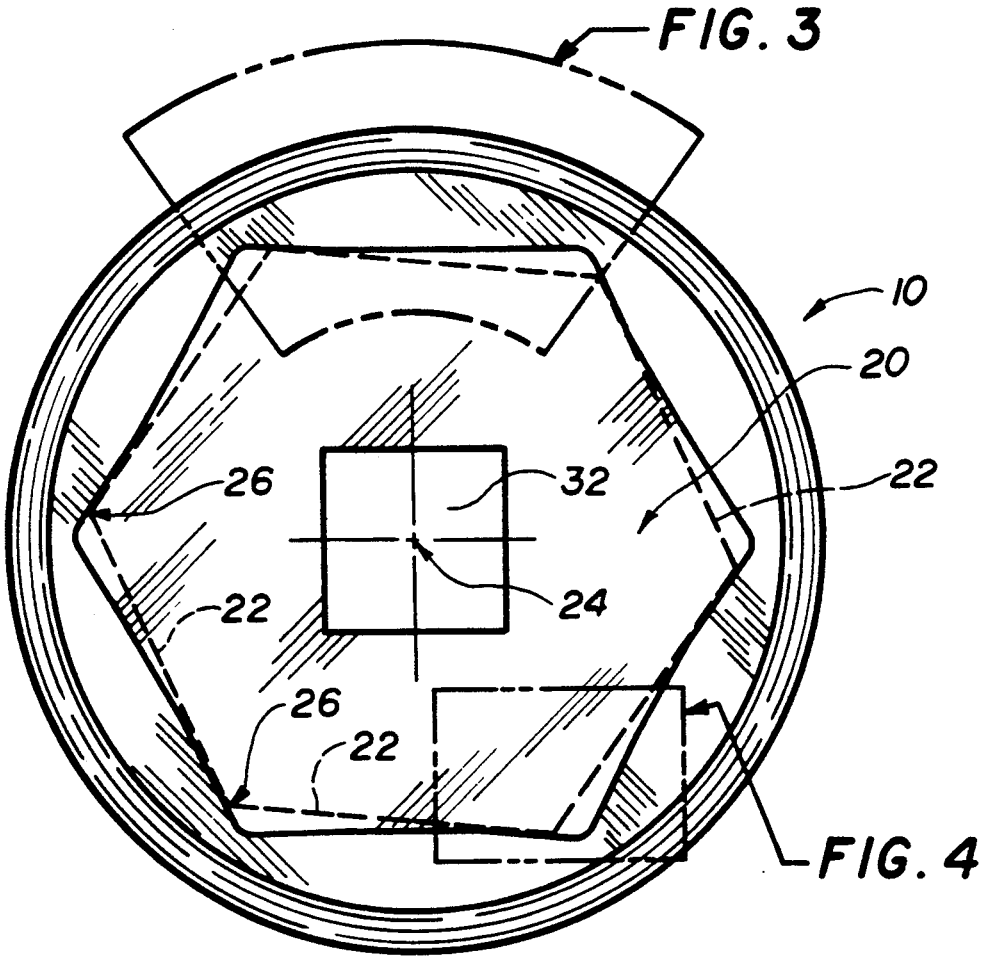
FIG. 2 is an enlarged plan view of the socket shown in FIG. 1.

The socket wrench 10 is comprised of a generally cylindrical body 30 which is provided at one end with a substantially square socket 32 (best seen in FIG. 2) for reception of the operating stem of a suitable socket wrench, a motor driven spindle or other actuating member (not shown). The other end of body 30 is provided with a work receiving cavity 34 which is symmetrical about an axis 35, which in FIG. 2 is coincident with axis 24 of fastener 20. Cavity 34 is comprised of an even-numbered plurality of uniformly spaced peripherally and radially disposed side walls 36 having an equal number of nut corner clearance recesses 38 disposed therebetween. (As used hereinafter, inward or inner shall designate a direction toward the central axis 35 of socket 10, and outward or outer shall designate a direction away from axis 35.)

Figure 3:
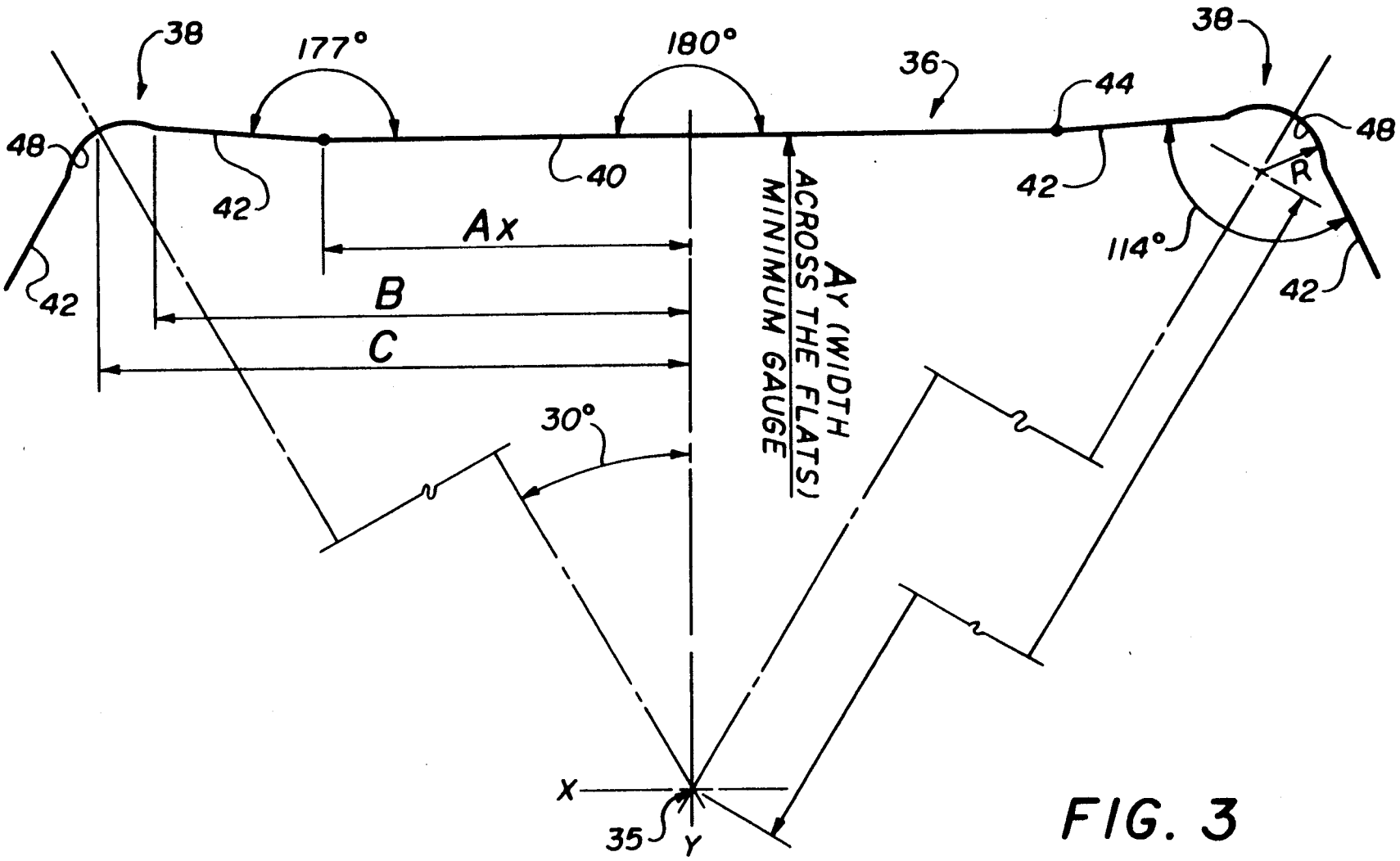
FIG. 3 is an enlarged view of area 3—3 of FIG. 2 illustrating a typical protuberance and corner recess of the socket shown in FIG. 1.

In the embodiment shown, socket 10 includes six (6) side walls 36 and six (6) corner recesses 38. In FIG. 3 an enlarged portion of a socket according to the present invention is shown in relation to axes designated "X" and "Y" which are normal to each other and intersect at the central axis 35 of the socket. Each side wall 36 includes a planar surface 40 and two complimentary surfaces 42 disposed at each end of planar surface 40. Complimentary surfaces 42 diverge outwardly from surface 40 at inflection points 44. In the embodiment shown, complimentary surfaces 42 diverge away from planar surface 40 at a three degree (3°) angle.

Nut corner recesses 38 are generally comprised of rounded, i.e. radiused, corners 48 which project outward from adjacent complimentary surfaces 42.

The length and orientation of the planar surfaces defining socket cavity 34 is determined by the size of the fastener nut 20 to be turned as well as certain design criteria. In this respect, these planar surfaces are modified by creating complementary surfaces 42 to act as the driving surfaces to avoid contact with the corners 26 of fastener 20 as explained earlier and shown in FIG. 4; to minimize stress concentrations by avoiding sharp arcuate angles such as at the corner recesses 38; to provide a more parallel engagement between planar surfaces 40 and fastener faces 22. As shown in FIG. 3, the shape of the socket opening 34 may be defined with reference to X-Y coordinates relation to central axis 35. The specific dimensions of the respective surfaces of socket cavity 34 are preferably determined by the following formulas.

$Ay$ = MINIMUM FLATS ACROSS THE (GAUGE)

$$Ax = 0.6\left(\frac{Ay}{4\ \mathrm{Cos}\ 30^\circ}\right)$$

$$B = Ax + \left[\left(\frac{Ay}{\mathrm{Cos}\ 30^\circ} + .004\right)0.5 - R\right]\mathrm{Sin}\ 30^\circ - (Ax + R\ \mathrm{Sin}\ 25.936^\circ)$$

$$C = B + 2.1508\ [R\ \mathrm{Sin}\ 25.936^\circ]$$

$$R = .0712\ Ay$$

In the aforementioned formulas, "MINIMUM FLATS" refers to the industry standard mean dimension across the flats of a minimum gauge (typically referred to as a "GO-gauge") for the fastener to be driven. The length of surfaces 40, 42 may be calculated using the above formulas and standard trigonometric functions.

As heretofore described, complimentary surfaces 42 diverge from planar surface 40 at a three degree (3°) angle. Surfaces 42 diverge from planar surface 40 to avoid contact between the driving surface (i.e. items 40, 42) of socket 30 and the corner of the fastener to be driven, inasmuch as such contact produces high stress concentration in socket 30. At the same time, the orientation of surface 40 and complimentary surfaces 42 should take into account the position of the wrench at engagement with the fastener during actual driving, which position depends upon the amount of clearance between the wrench and the fastener. More specifically, as the clearance is taken up in turning the wrench to engage the fastener, there is an angular displacement of the wrench relative to the fastener. Thus there is a need to select an angle between surface 40 and surfaces 42 which best matches that of fastener 20 at that specific position.

Figure 4:
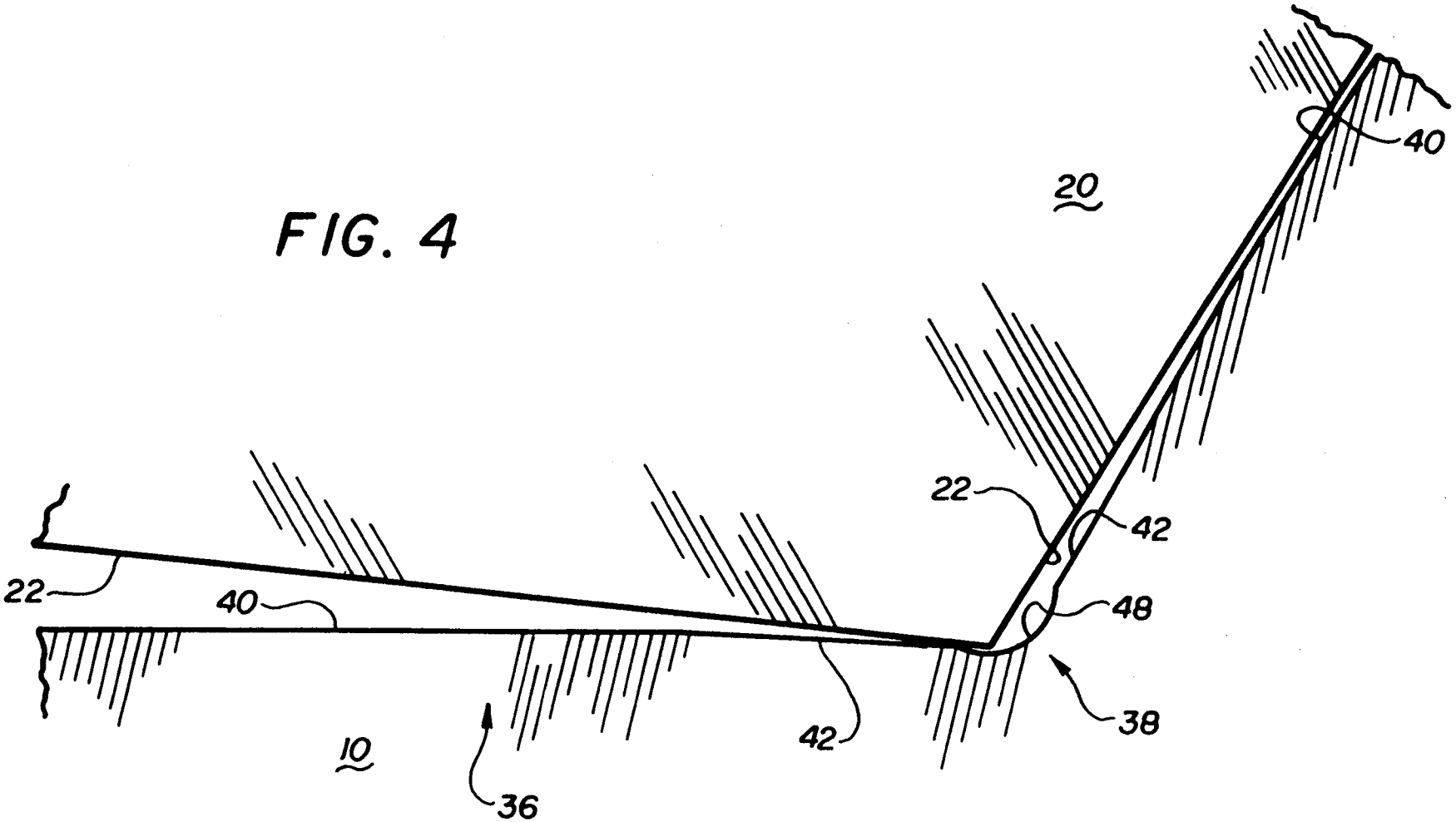
FIG. 4 is an enlarged view showing the typical surface contact between the engaging face of a socket according to the present invention an the flat portion of a hexagonal fastener.

FIG. 4 illustrates the position of the respective surfaces of socket opening 34 and a minimum sized (pursuant to a GO-gauge as discussed earlier) fastener 20. As can be seen, complimentary surface 42 engages the planar face 22 of fastener 20. Because complimentary surface 42 diverges from planar surface 40, it engages face 22 of fastener 20 at a less abrupt angle than would planar surface 40. In this respect, as indicated above, complimentary surface 42 diverges from planar surface 40 at an angle of three degrees (3°). Importantly, at this angle, the operative surfaces of socket opening 34 engage fastener 20 at a less severe angle than standard hexagonal sockets, yet greatly reduces the rotation of socket 30 needed to engage fastener 20. The latter avoids giving the user the impression that socket 30 is oversized in the event that socket 30 has the maximum socket opening 34 permitted (determined by conventional GO and NO GO gauges) and is used with a minimum sized fastener 20.

Importantly, according to the present invention, rounded corners 48 project outward from complimentary surfaces 42, with the outer most point of corner 48 is sized to accept the specific fastener size of that wrench and is dimensioned to be large enough so as not to load the corners of the fastener and at the same time large enough to reduce stress concentrations at the corners of socket opening 34. With respect to the later, rounded corners 48 are disposed to maximize the wall thickness in this area of socket 30.

Thus, the present invention provides a socket opening design which avoids contact with the fastener corner that produces high stress concentrations. In addition, the present invention provides a socket design wherein the corner clearance recesses avoid sharp surfaces by providing a generally rounded corner further reducing stress concentration.

The present invention has been described with respect to a preferred embodiment. Modifications and alterations will occur to others upon the reading and understanding of this specification. It is intended that all such modifications and alterations be included insofar as they come within the scope of the patent as claimed or the equivalence thereof.

Having thus described the invention, the following is claimed:

1. A wrench for turning a fastener, the fastener having a central axis and an even-numbered plurality of flat bounding surfaces parallel to the central axis with diametrically opposed pairs of flat bounding surfaces being parallel to each other, and the bounding surfaces of the fasteners meeting to form fastener corners, said wrench having a central opening axis and comprising:

a plurality of uniformly spaced sides disposed peripherally and radially about said central axis; said sides being equal in number to the number of flat bounding surfaces of the fasteners to be turned and diametrically opposed sides being generally parallel;

a plurality of uniformly spaced corner recesses disposed peripherally and radially about said central opening axis, where projected adjacent sides would meet, each corner recess being part of a circle having a radius of curvature of approximately 0.075 times (×) the minimum dimension across the flats of a minimum gauge (GO-gauge) used to establish the minimum wrench opening for the fastener to be turned; and each side including a planar surface disposed between a pair of complimentary surfaces, each complimentary surface extending from an end of the planar surfaces and diverging outwardly from said central opening axis by approximately 3° from the adjacent planar surfaces and intersecting the adjacent corner recess;

the planar surface of each side being spaced from the planar surface of the diametrically opposed side by a distance equal to the minimum dimension across the flats of a minimum gauge (GO-gauge) used to establish the minimum wrench opening for the fastener to be driven; and having a length substantially equal to 0.35 times (×) the minimum dimension across the flats of minimum gauge (GO-gauge) used to establish the minimum wrench opening of the fastener to be driven;

said wrench having relatively thick wall thickness at the corners, a large corner radius to reduce stress concentration, a low contact angle between the respective sides and the fastener being turned, and a low angle of rotation before the wrench starts turning one fastener.

* * * * *